US012428110B2

(12) United States Patent
Okamoto et al.

(10) Patent No.: US 12,428,110 B2
(45) Date of Patent: Sep. 30, 2025

(54) BOAT CONTROL SYSTEM AND MARINE VESSEL

(71) Applicant: YAMAHA HATSUDOKI KABUSHIKI KAISHA, Iwata (JP)

(72) Inventors: Yukitaka Okamoto, Shizuoka (JP); Mitsuyoshi Nakamura, Shizuoka (JP); Mitsuaki Kurokawa, Osaka (JP); Shimpei Fukumoto, Osaka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 732 days.

(21) Appl. No.: 17/746,161

(22) Filed: May 17, 2022

(65) Prior Publication Data

US 2022/0371701 A1 Nov. 24, 2022

(30) Foreign Application Priority Data

May 18, 2021 (JP) ..... 2021-084122

(51) Int. Cl.
*B63B 34/70* (2020.01)
*B63H 11/11* (2006.01)

(52) U.S. Cl.
CPC ..... *B63B 34/70* (2020.02); *B63H 11/11* (2013.01)

(58) Field of Classification Search
CPC ..... B63B 34/70; B63H 11/11
See application file for complete search history.

(56) References Cited

U.S. PATENT DOCUMENTS

| | | | | |
|---|---|---|---|---|
| 5,041,040 | A * | 8/1991 | Jones | B63H 21/22 114/253 |
| 10,427,765 | B2 * | 10/2019 | Robinson | G06F 3/017 |
| 2007/0188616 | A1 * | 8/2007 | Goodwin | B63B 32/70 348/207.99 |
| 2012/0152162 | A1 * | 6/2012 | Jordan | B63B 34/60 114/253 |
| 2017/0323154 | A1 * | 11/2017 | Kollmann | G06V 20/59 |
| 2018/0004209 | A1 * | 1/2018 | Akuzawa | G05D 1/0206 |
| 2018/0284762 | A1 * | 10/2018 | Green | B63B 34/75 |
| 2021/0261229 | A1 * | 8/2021 | Terada | B63H 25/04 |
| 2022/0089259 | A1 * | 3/2022 | Williams | B63C 9/0005 |
| 2022/0371701 | A1 * | 11/2022 | Okamoto | B63B 34/70 |
| 2023/0002022 | A1 * | 1/2023 | Uggeri | B63B 34/60 |

FOREIGN PATENT DOCUMENTS

| | | |
|---|---|---|
| JP | 2017-215947 A | 12/2017 |
| JP | 2019-123492 A | 7/2019 |

* cited by examiner

*Primary Examiner* — S. Joseph Morano
*Assistant Examiner* — Jovon E Hayes
(74) *Attorney, Agent, or Firm* — Keating & Bennett, LLP

(57) ABSTRACT

A boat control system includes an imager to image a user towed by a hull, an image processor to determine a predetermined state of the user from an image captured by the imager, and a controller configured or programmed to perform a control to adjust a thruster operable to change a propulsion state of the hull based on the predetermined state of the user determined by the image processor to change the propulsion state of the hull.

20 Claims, 6 Drawing Sheets

BOAT CONTROL SYSTEM AND MARINE VESSEL

CROSS REFERENCE TO RELATED APPLICATIONS

This application claims the benefit of priority to Japanese Patent Application No. 2021-084122 filed on May 18, 2021. The entire contents of this application are hereby incorporated herein by reference.

BACKGROUND OF THE INVENTION

1. Field of the Invention

The present invention relates to a boat control system and a marine vessel, and more particularly, it relates to a boat control system for a user towed by a marine vessel to change the propulsion state of a hull by himself/herself and a marine vessel.

2. Description of the Related Art

A boat control system for a user towed by a marine vessel to change the propulsion state of a hull by himself/herself is known in general. Such a boat control system is disclosed in U.S. Patent Application Publication No. 2018/0284762, for example.

U.S. Patent Application Publication No. 2018/0284762 discloses a boat control system including a control device attached to the wrist of a user towed by a hull. This control device includes various buttons to change the propulsion state of the hull, such as a button to change the propulsion speed of the hull and a button to adjust the amount of water stored in ballast tanks to change the size of a wave toward the user. The user towed by the hull operates a button on the control device with their arm different from the arm to which the control device is attached.

In the boat control system disclosed in U.S. Patent Application Publication No. 2018/0284762, when the user towed by the hull operates various buttons of the control device, the line of sight of the user toward the hull is directed toward the various buttons of the control device, for example, such that the user towed by the hull may fall into the water. Therefore, it is conventionally desired to allow the user towed by the hull to easily change the propulsion state of the hull.

SUMMARY OF THE INVENTION

Preferred embodiments of the present invention provide boat control systems and marine vessels that each allow a user towed by a hull to easily change a propulsion state of the hull.

A boat control system according to a preferred embodiment of the present invention includes an imager to image a user towed by a hull, an image processor to determine a predetermined state of the user from an image captured by the imager, and a controller configured or programmed to perform a control to adjust a thruster operable to change a propulsion state of the hull based on the predetermined state of the user determined by the image processor to change the propulsion state of the hull.

A boat control system according to a preferred embodiment of the present invention includes the controller configured or programmed to perform a control to adjust the thruster operable to change the propulsion state of the hull based on the predetermined state of the user determined by the image processor operable to determine the predetermined state of the user from the image captured by the imager to change the propulsion state of the hull. Accordingly, the thruster operable to change the propulsion state of the hull is adjusted based on the predetermined state of the user determined by the image processor to change the propulsion state of the hull, and thus the user towed by the hull does not need to operate a button or the like of a control device attached to their wrist, unlike the conventional case. Therefore, the line of sight of the user toward the hull is not directed toward various buttons of the control device unlike the conventional case, and the user towed by the hull is able to continuously view the hull. Consequently, the user towed by the hull concentrates on being towed by the hull, and thus it becomes easy for the user towed by the hull to change the propulsion state of the hull.

In a boat control system according to a preferred embodiment of the present invention, the controller is preferably configured or programmed to perform a control to adjust the thruster based on the predetermined state of the user determined by the image processor and indicating a predetermined marine vessel operating instruction to change the propulsion state of the hull. Accordingly, the image processor determines the predetermined state of the user indicating the predetermined marine vessel operating instruction, and the propulsion state of the hull is changed, and thus the user actively (consciously) changes the propulsion state of the hull. Therefore, it becomes easier for the user towed by the hull to change the propulsion state of the hull.

In such a case, the controller is preferably configured or programmed to perform a control to adjust the thruster based on a gesture of the user determined by the image processor and indicating the predetermined marine vessel operating instruction to change the propulsion state of the hull. Accordingly, the user changes the propulsion state of the hull using the gesture, and thus the user no longer operates the button or the like. Thus, it becomes still easier for the user towed by the hull to change the propulsion state of the hull.

In a boat control system according to a preferred embodiment of the present invention, the image processor is preferably operable to determine that the user is in the predetermined state when the predetermined state of the user is continuously imaged by the imager for a predetermined period of time or longer. Accordingly, when the predetermined state of the user is continuously imaged by the imager for the predetermined period of time or longer, the image processor determines that the user is in the predetermined state, and thus a change in the propulsion state of the hull based on an image instantaneously captured by the imager, for example, which is not intended by the user is significantly reduced or prevented.

In a boat control system according to a preferred embodiment of the present invention, the controller is preferably configured or programmed to perform a control to adjust the thruster to change at least one of a propulsion speed of the hull or a shape of a wave toward the user. Accordingly, at least one of the propulsion speed of the hull or the shape of the wave toward the user is changed, and thus when the user towed by the hull is performing wakeboarding, wakesurfing, or the like, the propulsion state of the hull is easily adjusted to a state desired by the user.

In such a case, the thruster preferably includes at least one of an engine or a motor corresponding to a drive source for a propulsion generator operable to generate a propulsive force of the hull, and the controller is preferably configured or programmed to perform a control to adjust a magnitude of a driving force of at least one of the engine or the motor based on the predetermined state of the user to change the propulsion speed of the hull. Accordingly, the magnitude of the driving force of at least one of the engine or the motor is adjusted such that the propulsion speed of the hull is easily changed.

In a boat control system including the controller configured or programmed to perform a control to adjust the thruster to change at least one of the propulsion speed of the hull or the shape of the wave toward the user, the thruster preferably includes a ballast tank mounted on the hull and a ballast pump to change an amount of water stored in the ballast tank, and the controller is preferably configured or programmed to perform a control to adjust the amount of water stored in the ballast tank with the ballast pump based on the predetermined state of the user to change the shape of the wave toward the user. Accordingly, the amount of water stored in the ballast tank is adjusted by the ballast pump based on the predetermined state of the user such that the shape of the wave toward the user is easily changed.

In a boat control system including the controller configured or programmed to perform a control to adjust the thruster to change at least one of the propulsion speed of the hull or the shape of the wave toward the user, the thruster preferably includes a scoop device including an openable and closable water guide port and operable to generate a water flow toward a rear side of the hull by opening the openable and closable water guide port, and the controller is preferably configured or programmed to perform a control to switch opening and closing of the water guide port of the scoop device based on the predetermined state of the user to change the shape of the wave toward the user. Accordingly, the opening and closing of the water guide port of the scoop device are switched such that the shape of the wave toward the user is easily changed.

In a boat control system including the controller configured or programmed to perform a control to adjust the thruster based on the gesture to change the propulsion state of the hull, the image processor is preferably operable to determine at least one of the gesture of an upper limb of the user or the gesture of a lower limb of the user imaged by the imager as the predetermined marine vessel operating instruction of the user, and the controller is preferably configured or programmed to perform a control to adjust the thruster based on at least one of the gesture of the upper limb or the gesture of the lower limb determined by the image processor to change the propulsion state of the hull. Accordingly, the image processor determines the gesture of the upper limb or the lower limb of the user, which is a relatively easy-to-move body part, and the propulsion state of the hull is changed. Thus, it becomes particularly easy for the user towed by the hull to change the propulsion state of the hull.

In such a case, the controller is preferably configured or programmed to perform a control to adjust the thruster based on the image processor determining that the upper limb or a predetermined finger of a hand of the upper limb represents an upward pointing gesture to increase a propulsion speed of the hull, and adjust the thruster based on the image processor determining that the upper limb or the predetermined finger of the hand of the upper limb represents a downward pointing gesture to decrease the propulsion speed of the hull. Accordingly, the propulsion speed of the hull is changed by the simple gesture in which the upper limb or the predetermined finger of the hand of the upper limb is pointed upward or downward.

In a boat control system including the controller configured or programmed to perform a control to adjust the thruster based on at least one of the gesture of the upper limb or the gesture of the lower limb to change the propulsion state of the hull, the controller is preferably configured or programmed to perform a control to adjust the thruster based on the image processor determining that the upper limb or a predetermined finger of a hand of the upper limb represents an upward pointing gesture to increase a size of a wave toward the user, and adjust the thruster based on the image processor determining that the upper limb or the predetermined finger of the hand of the upper limb represents a downward pointing gesture to decrease the size of the wave toward the user. Accordingly, the size of the wave toward the user is changed by the simple gesture in which the upper limb or the predetermined finger of the hand of the upper limb is pointed upward or downward.

In a boat control system including the controller configured or programmed to perform a control to adjust the thruster based on at least one of the gesture of the upper limb or the gesture of the lower limb to change the propulsion state of the hull, the controller is preferably configured or programmed to perform a control to adjust the thruster based on the image processor determining that the upper limb represents a leftward pointing gesture to generate a wave toward the user on a port side of the hull, and adjust the thruster based on the image processor determining that the upper limb represents a rightward pointing gesture to generate the wave toward the user on a starboard side of the hull. Accordingly, the wave toward the user is generated on the port side or the starboard side of the hull by the simple gesture in which the upper limb is pointed leftward or rightward.

In a boat control system according to a preferred embodiment of the present invention, the controller is preferably configured or programmed to perform a control to adjust the thruster to stop the hull based on the image processor determining that the predetermined state of the user is a state in which the user has fallen into water. Accordingly, when the user falls into the water, the hull is automatically stopped without a marine vessel operator performing a stop operation.

In a boat control system according to a preferred embodiment of the present invention, the controller is preferably configured or programmed to perform a control to adjust the thruster to gradually increase a propulsion speed of the hull based on the image processor determining that the predetermined state of the user is a state in which a lower limb of the user is located in water and propulsion of the hull is started when the hull is stopped. Accordingly, when the propulsion of the hull is started, the user is automatically and smoothly shifted to a posture of riding on a wakesurfing board or a wakeboard without the marine vessel operator performing a start operation.

In a boat control system according to a preferred embodiment of the present invention, the image processor is preferably operable to individually determine the user, the boat control system preferably further includes a storage to store user determination data of the user determined by the image processor and adjustment control data acquired by adjusting the thruster for each user with the controller in association with each other, and the controller is preferably configured or programmed to perform a control to perform personal authentication of the user based on image data of the user captured by the imager and the user determination data stored in the storage when propulsion of the hull is started, identify the adjustment control data associated with the user determination data of the authenticated user based on a result of the personal authentication, and change an initial propulsion state of the hull to an initial setting state for the authenticated user based on the identified adjustment control data. Accordingly, the towed user is determined by personal authentication, and thus the initial propulsion state of the hull is automatically set to the initial setting state such as a predetermined propulsion speed suitable for the towed user.

In a boat control system according to a preferred embodiment of the present invention, the controller preferably includes a boat control unit configured or programmed to perform a control to automatically operate a marine vessel, and the boat control unit is preferably configured or programmed to perform a control to adjust the thruster based on the predetermined state of the user determined by the image processor to change the propulsion state of the hull in addition to performing the control to automatically operate the marine vessel. Accordingly, the boat control unit is used not only to automatically operate the marine vessel, but also for the towed user to operate the marine vessel. Therefore, the system structure is simplified as compared with a case in which a dedicated control device for the towed user to operate the marine vessel is provided separately from the boat control unit.

A boat control system according to a preferred embodiment of the present invention preferably further includes a handle including an on-off switch, connected to the hull via a rope, and gripped by the user, and the controller is preferably configured or programmed to perform a control to adjust the thruster based on a combination of the predetermined state of the user determined by the image processor and an on or off state of the on-off switch to change the propulsion state of the hull. Accordingly, the image processor distinguishes between the predetermined state of the user with the on-off switch pressed and the predetermined state of the user without the on-off switch pressed, and thus the number of patterns of the predetermined state of the user is increased.

A marine vessel according to a preferred embodiment of the present invention includes a hull and a boat control system mounted on the hull. The hull includes a thruster to change a propulsion state of the hull, and the boat control system includes an imager to image a user towed by the hull, an image processor to determine a predetermined state of the user from an image captured by the imager, and a controller configured or programmed to perform a control to adjust the thruster based on the predetermined state of the user determined by the image processor to change the propulsion state of the hull.

A marine vessel according to a preferred embodiment of the present invention includes the controller configured or programmed to perform a control to adjust the thruster operable to change the propulsion state of the hull based on the predetermined state of the user determined by the image processor operable to determine the predetermined state of the user from the image captured by the imager to change the propulsion state of the hull. Accordingly, the thruster operable to change the propulsion state of the hull is adjusted based on the predetermined state of the user determined by the image processor to change the propulsion state of the hull, and thus the user towed by the hull does not need to operate a button or the like of a control device attached to their wrist, unlike the conventional case. Therefore, the line of sight of the user toward the hull is not directed toward various buttons of the control device unlike the conventional case, and the user towed by the hull is able to continuously view the hull. Consequently, the user towed by the hull concentrates on being towed by the hull, and thus it becomes easy for the user towed by the hull to change the propulsion state of the hull.

In a marine vessel according to a preferred embodiment of the present invention, the controller is preferably configured or programmed to perform a control to adjust the thruster based on the predetermined state of the user determined by the image processor and indicating a predetermined marine vessel operating instruction to change the propulsion state of the hull. Accordingly, the image processor determines the predetermined state of the user indicating the predetermined marine vessel operating instruction, and the propulsion state of the hull is changed, and thus the user actively (consciously) changes the propulsion state of the hull. Therefore, it becomes easier for the user towed by the hull to change the propulsion state of the hull.

In a marine vessel according to a preferred embodiment of the present invention, the thruster preferably includes a jet thruster to jet water, and the marine vessel is preferably a jet propelled boat. Accordingly, in the jet propelled boat including the jet thruster, the user towed by the hull easily changes the propulsion state of the hull.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a jet propelled boat 100 including a boat control system 102 according to preferred embodiments of the present invention is now described with reference to FIGS. 1 to 10.

In the figures, arrow FWD represents the forward movement direction of the jet propelled boat 100 (front side with reference to a hull 101), and arrow BWD represents the reverse movement direction of the jet propelled boat 100 (rear side with reference to the hull 101).

In the figures, arrow L represents the portside direction of the jet propelled boat 100 (portside direction with respect to the hull 101), and arrow R represents the starboard direction of the jet propelled boat 100 (starboard direction with respect to the hull 101).

Figure 1:
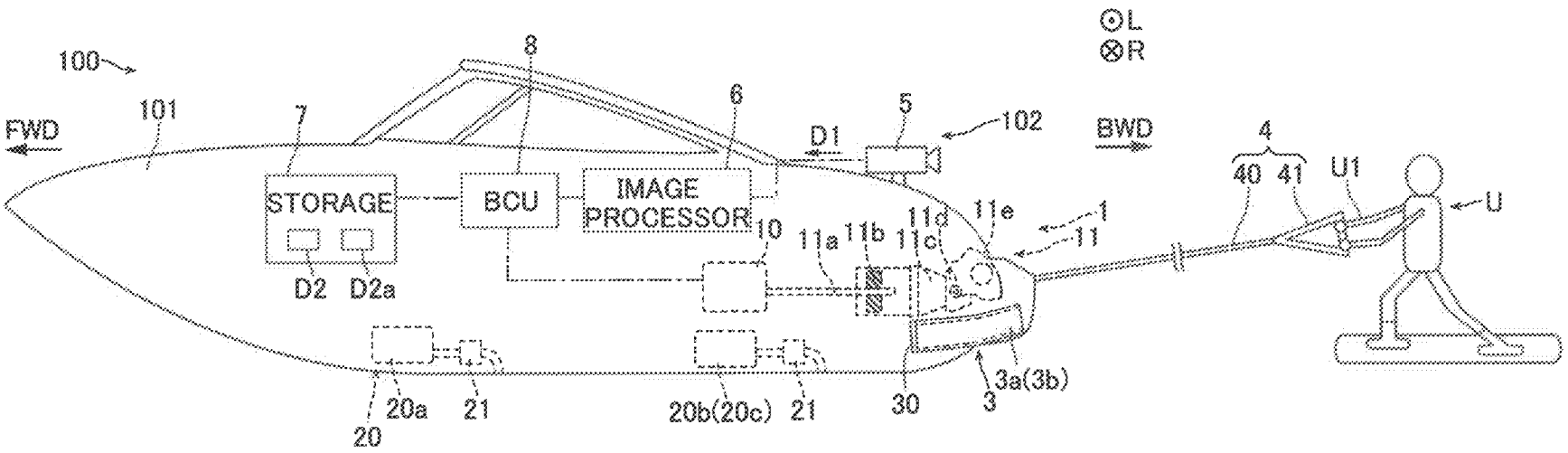
FIG. 1 is a side view showing a jet propelled boat according to a preferred embodiment of the present invention.
Figure 2:
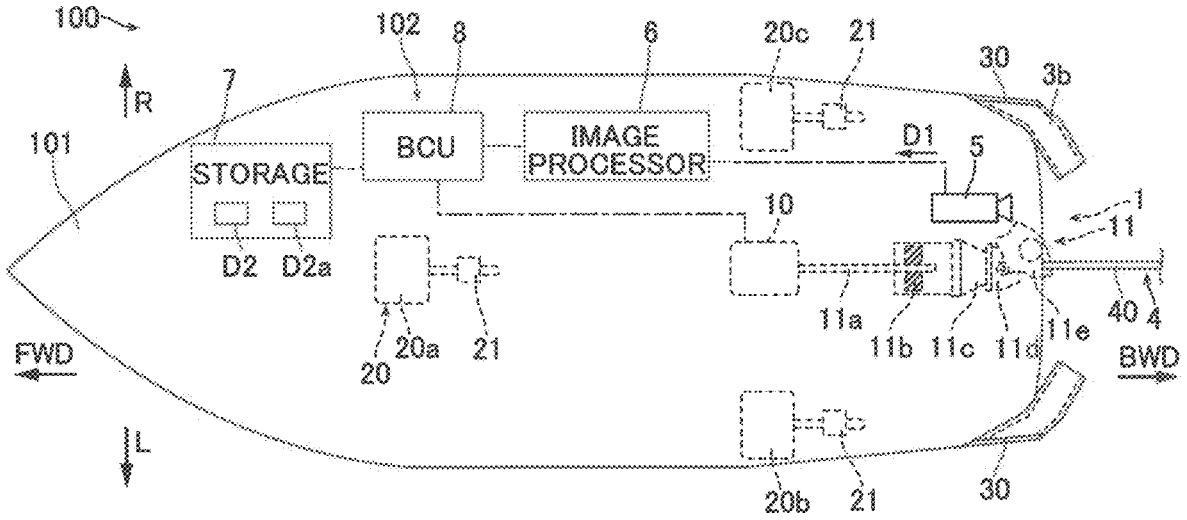
FIG. 2 is a plan view showing a jet propelled boat according to a preferred embodiment of the present invention.

As an example, the jet propelled boat 100 including a boat control system 102 shown in FIGS. 1 and 2 is used for applications such as wakeboarding and wakesurfing in which a user U is towed by a towing tool 4 of the jet propelled boat 100.

The boat control system 102 images the user U towed by the jet propelled boat 100 with an imager 5. Then, the boat control system 102 determines, with an image processor 6, a predetermined state of the user U such as a gesture (see G10, G11, G20, G21, G30, and G31 shown in FIGS. 6, 8, and 10) from an image captured by the imager 5. Consequently, the boat control system 102 performs a control, with a boat control unit 8, to adjust a jet thruster 1, which is operable to change the propulsion state of the hull 101, based on the predetermined state of the user U determined by the image processor 6 to change the propulsion state of the hull 101.

That is, the user U towed by the jet propelled boat 100 is able to perform the driving operation of the jet propelled boat 100 such as changing the propulsion speed of the jet propelled boat 100 with the boat control system 102 while being towed by the jet propelled boat 100.

The jet propelled boat 100 includes the hull 101 and the boat control system 102 mounted on the hull 101.

The hull 101 includes the jet thruster 1, ballast tanks 20, ballast pumps 21, scoop devices 3, and the towing tool 4. The jet thruster 1, the ballast tanks 20, the ballast pumps 21, and the scoop devices 3 are examples of a "thruster".

The jet thruster 1 includes an engine 10 and a propulsion generator 11 driven by the engine 10.

The engine 10 is a drive source for the propulsion generator 11. The magnitude (rotation speed) of the driving force of the engine 10 is adjusted such that the propulsion speed of the jet propelled boat 100 is adjusted.

The propulsion generator 11 is driven by the engine 10 to suction water via a water suction port (not shown) provided on the hull 101 and jet the suctioned water from a nozzle 11*c*. Consequently, the jet propelled boat 100 is propelled. The propulsion generator 11 includes a drive shaft 11*a*, an impeller 11*b*, the nozzle 11*c*, a deflector 11*d*, and a bucket 11*e*.

The drive shaft 11*a* is connected to a crankshaft of the engine 10 and extends rearward from the engine 10. The impeller 11*b* is fixed in the vicinity of or adjacent to the rear end of the drive shaft 11*a*.

The impeller 11*b* is provided in the hull 101 and located in a water flow path connected to the nozzle 11*c* on the downstream side. The impeller 11*b* rotates together with the drive shaft 11*a* to generate a flow toward the nozzle 11*c* in the water flow path. As the rotation speed of the engine 10 increases, the flow toward the nozzle 11*c* increases, and as the rotation speed of the engine 10 decreases, the flow toward the nozzle 11*c* decreases.

The nozzle 11*c* is located at the most downstream position of the water flow path in which the impeller 11*b* is located. The nozzle 11*c* functions as a water discharge port (jetting port). That is, the nozzle 11*c* jets water to apply a thrust to the hull 101. The deflector 11*d* and the bucket 11*e* are installed on the nozzle 11*c*.

The deflector 11*d* is rotatable in a right-left direction about an axis extending in an upward-downward direction. That is, the deflector 11*d* changes the direction of the water jetted from the nozzle 11*c* to the right-left direction. The deflector 11*d* rotates in the right-left direction in response to an operation on an operator of the hull 101.

The bucket 11*e* is rotatable in the upward-downward direction about an axis extending in the right-left direction. That is, the bucket 11*e* changes the direction of the water jetted from the nozzle 11*c* to a forward-rearward direction. The bucket 11*e* rotates in the upward-downward direction in response to an operation on the operator of the hull 101.

The ballast tanks 20 store water, and a plurality of (three) ballast tanks are provided on the hull 101. The ballast tanks 20 are located on the bottom of the boat.

The ballast tanks 20 includes a central ballast tank 20*a*, a left ballast tank 20*b*, and a right ballast tank 20*c*.

The central ballast tank 20*a* is located on the center line of the hull 101 in the right-left direction and on the front side of the hull 101. The left ballast tank 20*b* is located on the left side relative to the center line of the hull 101 in the right-left direction and on the rear side relative to the central ballast tank 20*a*. The right ballast tank 20*c* is located on the right side relative to the center line of the hull 101 in the right-left direction and on the rear side relative to the central ballast tank 20*a*.

One ballast pump 21 is provided for each ballast tank 20. The ballast pump 21 pumps water from the outside of the jet propelled boat 100 or discharges water to the outside to change the amount of water stored in the ballast tank 20.

The jet propelled boat 100 (boat control system 102) lowers the position of the entire hull 101 with respect to the water surface during propulsion when the ballast pumps 21 increase the amounts of water stored in all the ballast tanks 20*a*, 20*b*, and 20*c*. Consequently, the jet propelled boat 100 increases the size of a wave from the hull 101 toward the user U during propulsion.

The jet propelled boat 100 (boat control system 102) raises the position of the entire hull 101 with respect to the water surface during propulsion when the ballast pumps 21 decrease the amounts of water stored in all the ballast tanks 20*a*, 20*b*, and 20*c*. Consequently, the jet propelled boat 100 decreases the size of the wave from the hull 101 toward the user U during propulsion.

The jet propelled boat 100 (boat control system 102) tilts the hull 101 such that the left side of the hull 101 is lower when the amount of water stored in the left ballast tank 20*b* is adjusted to be larger than the amount of water stored in the right ballast tank 20*c* by the ballast pump 21. Consequently, the jet propelled boat 100 increases the size of a left-hand wave from the hull 101 toward the user U during propulsion.

The jet propelled boat 100 (boat control system 102) tilts the hull 101 such that the right side of the hull 101 is lower when the amount of water stored in the right ballast tank 20*c* is adjusted to be larger than the amount of water stored in the left ballast tank 20*b* by the ballast pump 21. Consequently, the jet propelled boat 100 increases the size of a right-hand wave from the hull 101 toward the user U during propulsion.

The scoop devices 3 are tubular members that allow water outside the jet propelled boat 100 to pass therethrough, and a plurality of (two) scoop devices 3 are provided on the hull 101. The scoop devices 3 each include a water guide port 30 that is openable and closable. That is, the water guide port 30 includes an openable and closable lid (not shown) to take in water from the outside. The scoop devices 3 generate a water flow (wave) toward the rear side of the hull 101 by opening the water guide ports 30. The opening and closing of the water guide ports 30 of the scoop devices 3 are switched such that the shape of the wave from the hull 101 to the user U changes.

The scoop devices 3 includes a left scoop device 3*a* and a right scoop device 3*b*.

The left scoop device 3*a* is located at the left end in the vicinity of or adjacent to the rear end of the hull 101. The right scoop device 3*b* is located at the right end in the vicinity of or adjacent to the rear end of the hull 101.

Figure 3:
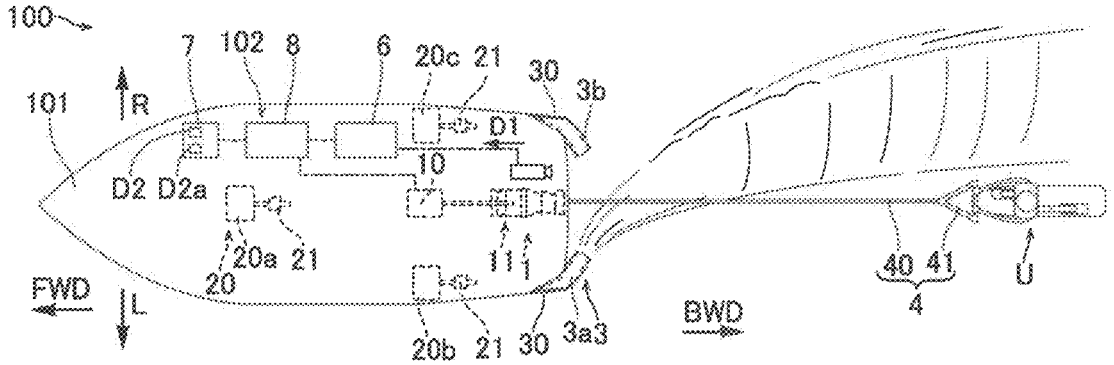
FIG. 3 is a plan view showing a state in which a wave is generated on the right side of a hull by a scoop device of a jet propelled boat according to a preferred embodiment of the present invention.

As shown in FIG. 3, the jet propelled boat 100 (boat control system 102) opens the water guide port 30 of the left scoop device 3*a* and closes the water guide port 30 of the right scoop device 3*b* during propulsion to generate a right-hand wave from the hull 101 toward the user U, or to increase the size of the right-hand wave.

Figure 4:
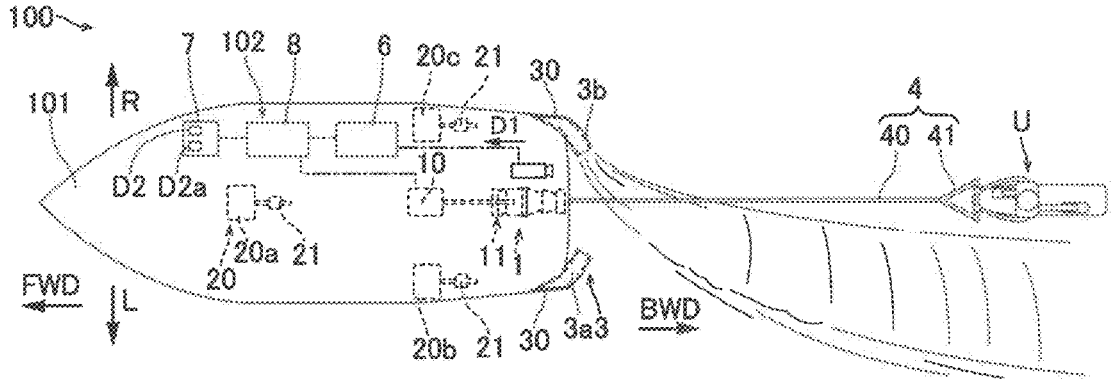
FIG. 4 is a plan view showing a state in which a wave is generated on the left side of a hull by a scoop device of a jet propelled boat according to a preferred embodiment of the present invention.

As shown in FIG. 4, the jet propelled boat 100 (boat control system 102) closes the water guide port 30 of the left scoop device 3*a* and opens the water guide port 30 of the right scoop device 3*b* during propulsion to generate a left-hand wave from the hull 101 toward the user U, or to increase the size of the left-hand wave.

The towing tool 4 includes a rope 40 and a handle 41.

A first end of the rope 40 is connected to the stern of the hull 101. A second end of the rope 40 is connected to the handle 41 gripped by the user U during towing.

The boat control system 102 shown in FIGS. 1 and 2 changes the propulsion state of the hull 101 based on the predetermined state of the user U towed by the jet propelled boat 100. In short, the boat control system 102 is mainly a system for the user U towed by the jet propelled boat 100 to control driving of the jet propelled boat 100.

The boat control system 102 includes the imager 5, the image processor 6, a storage 7, and the boat control unit (hereinafter referred to as a BCU) 8. The BCU 8 is an example of a "controller".

The imager 5 is attached to the hull 101. As an example, the imager 5 is attached in the vicinity of or adjacent to the stern of the hull 101. The angle of view of the imager 5 is adjusted to image at least a region behind the jet propelled boat 100 in order to image the user U towed by the jet propelled boat 100. The "region behind the jet propelled boat 100" refers to a range in which the user U who is performing wakeboarding or the like reliably falls within the angle of view of the imager 5 even when the user U moves in the right-left direction while being towed by the jet propelled boat 100. That is, the imager 5 is able to continuously image the towed user U except when the user U falls into the water.

The image processor 6 shown in FIGS. 1 and 2 acquires image data D1 obtained by imaging the towed user U from the imager 5 by wired communication or wireless communication. The image processor 6 determines the predetermined state of the user U from the image (image data D1) captured by the imager 5.

Specifically, the image processor 6 includes a storage (not shown) that stores (registers) various posture patterns of the user U in advance in order to determine the predetermined state of the user U. The "predetermined state of the user U" refers to a gesture that indicates a predetermined marine vessel operating instruction of the user U, a state in which the user U has fallen into the water from the wakeboard, or a state in which the lower limb of the user U is located in the water when the propulsion of the hull 101 is started, for example.

As an example, the image processor 6 determines a gesture (see G10, G11, G20, G21, G30, and G31 shown in FIGS. 6, 8, and 10) of the upper limb U1 of the user U imaged by the imager 5 as the predetermined marine vessel operating instruction of the user U.

These "predetermined states of the user U" are stored (registered) in advance in the storage of the image processor 6 as the posture patterns of the user U.

The image processor 6 performs an image recognition process as to whether or not the state of the user U in the image data D1 matches the posture pattern of the user U stored in advance in the storage.

Then, the image processor 6 determines that the user U is in the predetermined state when the state of the user U in the image data D1 matches the posture pattern of the user U stored in advance in the storage.

At this time, the image processor 6 determines that the user U is in the predetermined state when the predetermined state of the user U is continuously imaged by the imager 5 for a predetermined period of time or longer. As an example, the predetermined period of time is a short period of time of several seconds, such as one second, two seconds, or three seconds.

On the other hand, the image processor 6 determines that the user U is not in the predetermined state when the state of the user U in the image data D1 does not match the posture pattern of the user U stored in advance in the storage. That is, the image processor 6 does not determine that the user U is in the predetermined state when the state of the user U does not match the posture pattern of the user U.

In addition to this, the image processor 6 individually determines the user U. Specifically, the image processor 6 stores, in the storage 7, user determination data D2 to determine the user U, such as a face imaged by the imager 5. The image processor 6 may determine the user based on the color or pattern of the wet suit of the user U imaged by the imager 5.

The image processor 6 determines whether or not the data of the user U acquired from the image data D1 matches the user determination data D2 stored in the storage 7 when the imager 5 starts imaging the user U towed by the jet propelled boat 100. In short, the image processor 6 determines whether or not the user U has been towed by the jet propelled boat 100 in the past.

Consequently, when the image processor 6 determines that the user U has been towed by the jet propelled boat 100, the boat control system 102 changes the propulsion state of the hull 101 to a state of automatic adjustment suitable for the level of the towed user U based on adjustment control data D2*a* (data to adjust the propulsion state associated with the user determination data D2 of the user U) stored in the storage 7. The state of automatic adjustment is changeable afterwards based on the predetermined state of the towed user U such as a gesture.

The storage 7 stores data used to change the propulsion state of the hull 101 to the state of automatic adjustment suitable for the level of the towed user U. Specifically, the storage 7 stores the user determination data D2 of the user U determined by the image processor 6 and the adjustment control data D2*a* acquired by adjusting the jet thruster 1, the ballast tanks 20, the ballast pumps 21, the scoop devices 3, etc. for each user U with the BCU 8 in association with each other.

The boat control unit (BCU) 8 is a control device including a central processing unit (CPU), a read-only memory (ROM), a random access memory (RAM), etc., for example.

The BCU 8 performs a control to automatically operate the jet propelled boat 100. As an example, "a control to automatically operate the jet propelled boat" includes a heading hold control to maintain the propulsion direction of the jet propelled boat 100, a course hold control to maintain the propulsion course of the jet propelled boat 100, and a fixed point holding control to maintain the position of the jet propelled boat 100. That is, the BCU 8 is a control device that enables a control mode to automatically operate the jet propelled boat 100.

In addition to performing a control to automatically operate the jet propelled boat 100 described above, the BCU 8 performs a control to adjust the jet thruster 1, the ballast tanks 20, the ballast pumps 21, and the scoop devices 3 based on the predetermined state of the user U determined by the image processor 6 to change the propulsion state of the hull 101.

The BCU 8 performs a control to adjust the jet thruster 1, the ballast tanks 20, the ballast pumps 21, and the scoop devices 3 based on the predetermined state of the user U determined by the image processor 6 and indicating the predetermined marine vessel operating instruction to change the propulsion state of the hull 101.

Specifically, the BCU 8 performs a control to adjust the jet thruster 1, the ballast tanks 20, the ballast pumps 21, and the scoop devices 3 based on the gesture of the user U determined by the image processor 6 and indicating the predetermined marine vessel operating instruction to change the propulsion state of the hull 101.

Consequently, the BCU 8 performs a control to adjust the jet thruster 1, the ballast tanks 20, the ballast pumps 21, and the scoop devices 3 to change the propulsion speed of the hull 101 and the shape of the wave toward the user U.

In order to change the propulsion state of the hull 101, the BCU 8 finally performs the following various controls.

The BCU 8 performs a control to adjust the magnitude of the driving force (rotation speed) of the engine 10 of the jet thruster 1 based on the predetermined state of the user U to change the propulsion speed of the hull 101. Furthermore, the BCU 8 performs a control to adjust the direction of the jet thruster 1 based on the predetermined state of the user U to change the propulsion direction of the hull 101.

The BCU 8 performs a control to adjust the amounts of water stored in the ballast tanks 20 (20*a*, 20*b*, and 20*c*) with the ballast pumps 21 based on the predetermined state of the user U to change the shape (i.e., the position in the right-left direction and size) of the wave toward the user U.

The BCU 8 performs a control to switch the opening and closing of the water guide ports 30 of the scoop devices 3 (3*a* and 3*b*) based on the predetermined state of the user U to change the shape (i.e., the position in the right-left direction and size) of the wave toward the user U.

The BCU 8 performs a control to adjust the jet thruster 1 to stop the hull 101 based on the image processor 6 determining that the predetermined state of the user U is the state in which the user U has fallen into the water. As an example, the "state in which the user U has fallen into the water" refers to a state in which the imager 5 is not able to image the lower limb of the user U when the hull 101 is not stopped, for example.

The BCU 8 performs a control to adjust the jet thruster 1 to gradually increase the propulsion speed of the hull 101 based on the image processor 6 determining that the predetermined state of the user U is the state in which the lower limb of the user U is located in the water and the propulsion of the hull 101 is started when the hull 101 is stopped.

The BCU 8 performs personal authentication of the user based on the image data D1 of the user U captured by the imager 5 and the user determination data D2 stored in the storage 7 when the propulsion of the hull 101 is started, and identifies the adjustment control data D2*a* associated with the user determination data D2 of the authenticated user U based on the result of the personal authentication.

Then, the BCU 8 performs a control to change the initial propulsion state of the hull 101 to an initial setting state for the authenticated user U based on the identified adjustment control data D2*a*.

As a specific example, a predetermined user U is set to an initial setting state of 50 km/h, and another predetermined user U different from the predetermined user U is set to an initial setting state of 70 km/h. That is, the BCU 8 sets the initial propulsion state of the hull 101 according to the level (the skill of wakesurfing, for example) of each user U.

Figure 5:
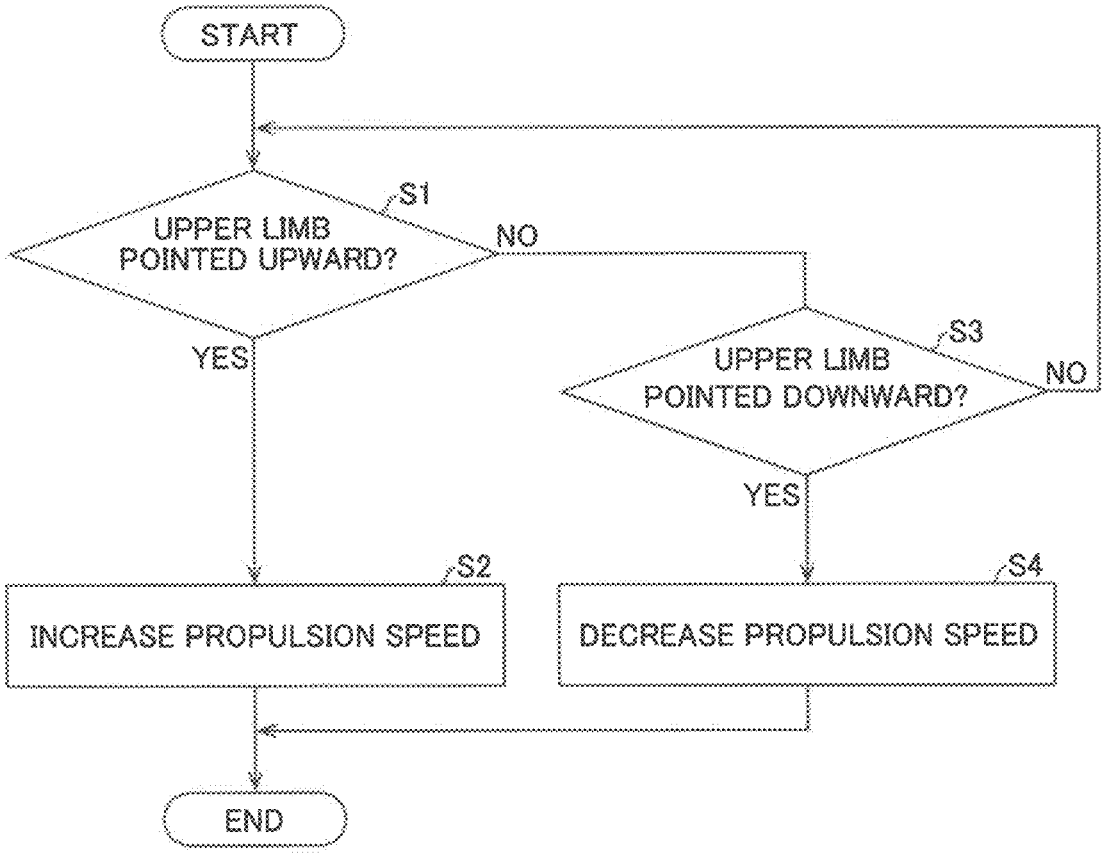
FIG. 5 is a flowchart showing a control process performed by a BCU of a jet propelled boat according to a preferred embodiment of the present invention to change the propulsion speed.
Figure 6:
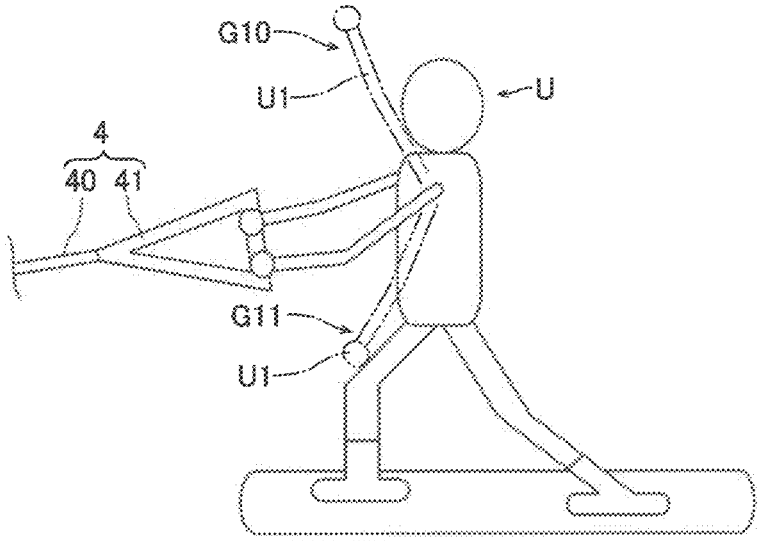
FIG. 6 is a diagram showing the gesture of a user when a control process is performed by a BCU to change the propulsion speed.

A flow of a control process performed by the BCU 8 to change the propulsion speed is now described with reference to FIGS. 5 and 6.

In step S1, it is determined whether or not information indicating that the right or left upper limb U1 of the user U towed by the hull 101 is pointed upward has been acquired from the image processor 6. That is, it is determined whether or not the gesture G10 of the user U shown in FIG. 6 is performed. When it is determined that the information indicating that the right or left upper limb U1 of the user U towed by the hull 101 is pointed upward has been acquired from the image processor 6, the process advances to step S2. When it is determined that the information indicating that the right or left upper limb U1 of the user U towed by the hull 101 is pointed upward has not been acquired from the image processor 6, the process advances to step S3.

Then, in step S2, the rotation speed of the engine 10 is increased, and the propulsion speed of the hull 101 is increased. Then, the control process to change the propulsion speed of the hull 101 is terminated.

In step S3, it is determined whether or not information indicating that the right or left upper limb U1 of the user U towed by the hull 101 is pointed downward has been acquired from the image processor 6. That is, it is determined whether or not the gesture G11 of the user U shown in FIG. 6 is performed. When it is determined that the information indicating that the right or left upper limb U1 of the user U towed by the hull 101 is pointed downward has been acquired from the image processor 6, the process advances to step S4. When it is determined that the information indicating that the right or left upper limb U1 of the user U towed by the hull 101 is pointed downward has not been acquired from the image processor 6, the process returns to step S1.

Then, in step S4, the rotation speed of the engine 10 is decreased, and the propulsion speed of the hull 101 is decreased. Then, the control process to change the propulsion speed of the hull 101 is terminated.

Figure 7:
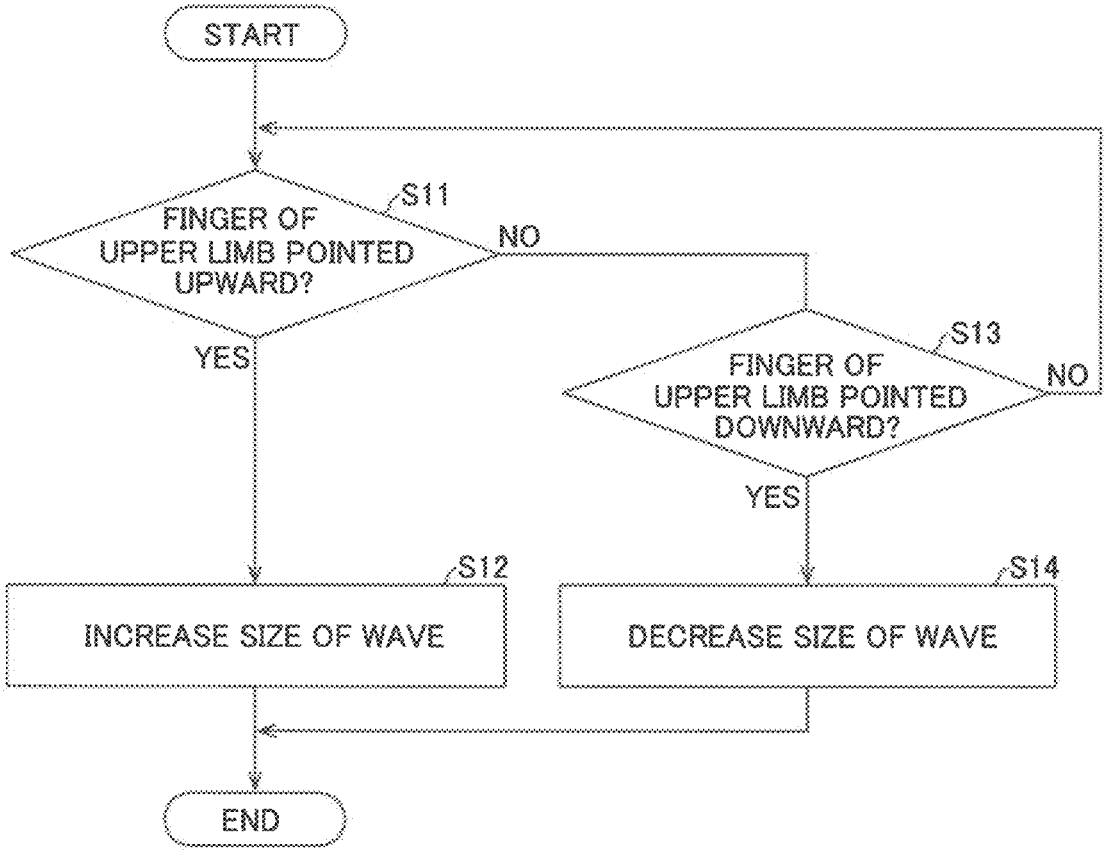
FIG. 7 is a flowchart showing a control process performed by a BCU of a jet propelled boat according to a preferred embodiment of the present invention to change the size of a wave toward a user.
Figure 8:
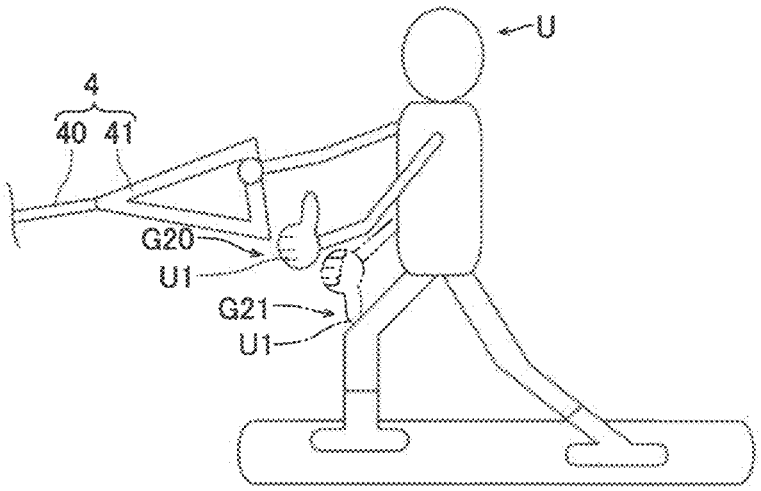
FIG. 8 is a diagram showing the gesture of a user when a control process is performed by a BCU to change the size of a wave toward the user.

A flow of a control process performed by the BCU 8 to change the size of the wave toward the user U is now described with reference to FIGS. 7 and 8.

In step S11, it is determined whether or not information indicating that a predetermined finger (a thumb, for example) of the right or left upper limb U1 of the user U towed by the hull 101 is pointed upward has been acquired from the image processor 6. That is, it is determined whether or not the gesture G20 of the user U shown in FIG. 8 is performed. When it is determined that the information indicating that the predetermined finger of the upper limb U1 is pointed upward has been acquired from the image processor 6, the process advances to step S12. When it is determined that the information indicating that the predetermined finger of the upper limb U1 is pointed upward has not been acquired from the image processor 6, the process advances to step S13.

Then, in step S12, the amounts of water stored in the entire (three) ballast tanks 20 (20*a*, 20*b*, and 20*c*) are increased, and the size of the wave toward the user U is increased. Then, the control process to change the size of the wave toward the user U is terminated.

In step S13, it is determined whether or not information indicating that the predetermined finger (a thumb, for example) of the right or left upper limb U1 of the user U towed by the hull 101 is pointed downward has been acquired from the image processor 6. That is, it is determined whether or not the gesture G21 of the user U shown in FIG. 8 is performed. When it is determined that the information indicating that the predetermined finger of the upper limb U1 is pointed downward has been acquired from the image processor 6, the process advances to step S14. When it is determined that the information indicating that the predetermined finger of the upper limb U1 is pointed downward has not been acquired from the image processor 6, the process returns to step S1.

Then, in step S14, the amounts of water stored in the entire (three) ballast tanks 20 (20*a*, 20*b*, and 20*c*) are decreased, and the size of the wave toward the user U is decreased. Then, the control process to change the size of the wave toward the user U is terminated. The control process to change the size of the wave toward the user U may be performed by adjusting the opening and closing of the water guide ports 30 of the scoop devices 3 (3*a* and 3*b*).

Figure 9:
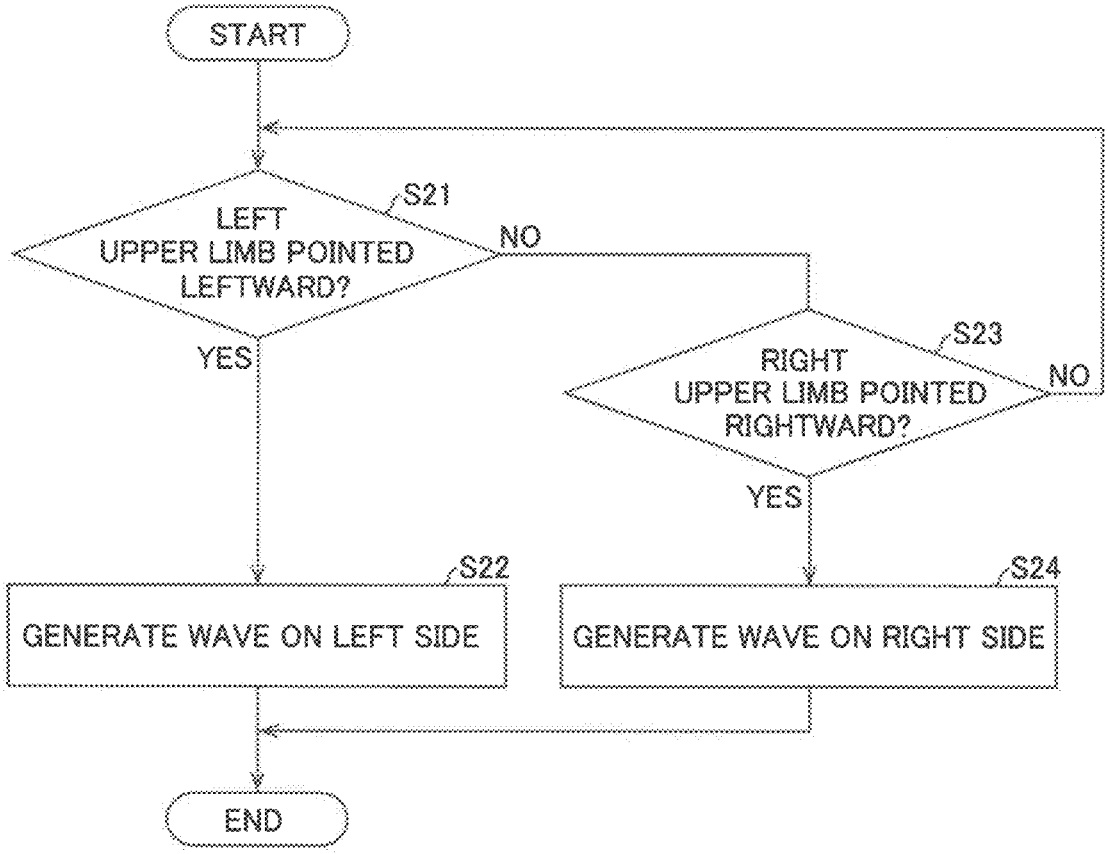
FIG. 9 is a flowchart showing a control process performed by a BCU of a jet propelled boat according to a preferred embodiment of the present invention to change the shape of a wave toward a user.
Figure 10:
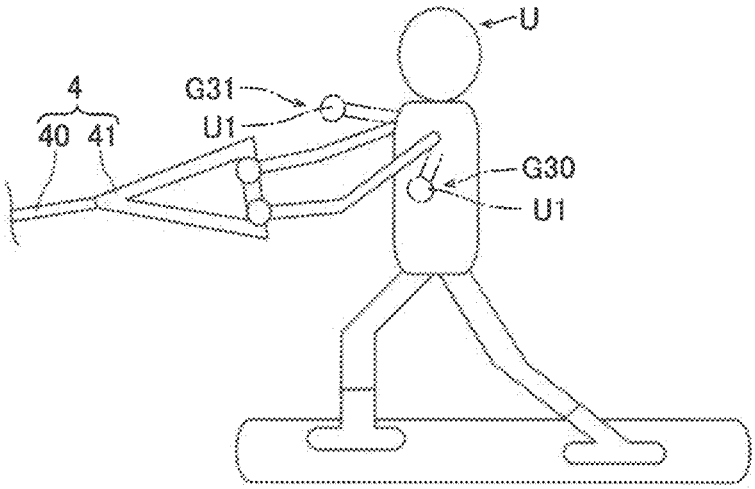
FIG. 10 is a diagram showing the gesture of a user when a control process is performed by a BCU to change the shape of a wave toward the user.

A flow of a control process performed by the BCU 8 to change the shape of the wave toward the user U is now described with reference to FIGS. 9 and 10.

In step S21, it is determined whether or not information indicating that the left upper limb U1 of the user U towed by the hull 101 is pointed to the left has been acquired from the image processor 6. That is, it is determined whether or not the gesture G30 of the user U shown in FIG. 10 is performed. When it is determined that the information indicating that the left upper limb U1 is pointed to the left has been acquired from the image processor 6, the process advances to step S22. When it is determined that the information indicating that the left upper limb U1 is pointed to the left has not been acquired from the image processor 6, the process advances to step S23.

Then, in step S22, the water guide port 30 of the right scoop device 3*b* is opened, and the water guide port 30 of the left scoop device 3*a* is closed such that the wave toward the user U is generated on the port side (left side). Then, the control process to change the shape of the wave toward the user U is terminated.

In step S23, it is determined whether or not information indicating that the right upper limb U1 of the user U towed by the hull 101 is pointed to the right has been acquired from the image processor 6. That is, it is determined whether or not the gesture G31 of the user U shown in FIG. 10 is performed. When it is determined that the information indicating that the right upper limb U1 is pointed to the right has been acquired from the image processor 6, the process advances to step S24. When it is determined that the information indicating that the right upper limb U1 is pointed to the right has been acquired from the image processor 6, the process returns to step S21.

Then, in step S24, the water guide port 30 of the left scoop device 3*a* is opened, and the water guide port 30 of the right scoop device 3*b* is closed such that the wave toward the user U is generated on the starboard side (right side). Then, the control process to change the shape of the wave toward the user U is terminated. The control process to change the shape of the wave toward the user U may be performed by adjusting the amounts of water stored in the ballast tanks 20.

According to the various preferred embodiments of the present invention described above, the following advantageous effects are achieved.

According to a preferred embodiment of the present invention, the boat control system 102 includes the boat control unit 8 configured or programmed to perform a control to adjust the thruster (the jet thruster 1, the ballast tanks 20, the ballast pumps 21, and the scoop devices 3) operable to change the propulsion state of the hull 101 based on the predetermined state of the user U determined by the image processor 6 operable to determine the predetermined state of the user U from the image captured by the imager 5 to change the propulsion state of the hull 101. Accordingly, the thruster that changes the propulsion state of the hull 101 is adjusted based on the predetermined state of the user U determined by the image processor 6 to change the propulsion state of the hull 101, and thus the user U towed by the hull 101 does not need to operate a button or the like of a control device attached to their wrist, unlike the conventional case. Therefore, the line of sight of the user U toward the hull 101 is not directed toward various buttons of the control device unlike the conventional case, and the user U towed by the hull 101 continues to visually recognize the hull 101. Consequently, the user U towed by the hull 101 concentrates on being towed by the hull 101, and thus it becomes easy for the user U towed by the hull 101 to change the propulsion state of the hull 101.

According to a preferred embodiment of the present invention, the boat control unit 8 is configured or programmed to perform a control to adjust the thruster (the jet thruster 1, the ballast tanks 20, the ballast pumps 21, and the scoop devices 3) based on the predetermined state of the user U determined by the image processor 6 and indicating the predetermined marine vessel operating instruction to change the propulsion state of the hull 101. Accordingly, the image processor 6 determines the predetermined state of the user U indicating the predetermined marine vessel operating instruction, and the propulsion state of the hull 101 is changed, and thus the user U actively (consciously) changes the propulsion state of the hull 101. Therefore, it becomes easier for the user U towed by the hull 101 to change the propulsion state of the hull 101.

According to a preferred embodiment of the present invention, the boat control unit 8 is configured or programmed to perform a control to adjust the thruster (the jet thruster 1, the ballast tanks 20, the ballast pumps 21, and the scoop devices 3) based on the gesture G10, G11, G20, G21, G30, or G31 of the user U determined by the image processor 6 and indicating the predetermined marine vessel operating instruction to change the propulsion state of the hull 101. Accordingly, the user U changes the propulsion state of the hull 101 using the gesture G10, G11, G20, G21, G30, or G31, and thus the user U no longer operates the button or the like. Thus, it becomes still easier for the user U towed by the hull 101 to change the propulsion state of the hull 101.

According to a preferred embodiment of the present invention, the image processor 6 is operable to determine that the user U is in the predetermined state when the predetermined state of the user U is continuously imaged by the imager 5 for the predetermined period of time or longer. Accordingly, when the predetermined state of the user U is continuously imaged by the imager 5 for the predetermined period of time or longer, the image processor 6 determines that the user U is in the predetermined state, and thus a change in the propulsion state of the hull 101 based on an image instantaneously captured by the imager 5, for example, which is not intended by the user U is significantly reduced or prevented.

According to a preferred embodiment of the present invention, the boat control unit 8 is configured or programmed to perform a control to adjust the thruster (the jet thruster 1, the ballast tanks 20, the ballast pumps 21, and the scoop devices 3) to change at least one of the propulsion speed of the hull 101 or the shape of the wave toward the user U. Accordingly, at least one of the propulsion speed of the hull 101 or the shape of the wave toward the user U is changed, and thus when the user U towed by the hull 101 is performing wakeboarding, wakesurfing, or the like, the propulsion state of the hull 101 is easily adjusted to a state desired by the user U.

According to a preferred embodiment of the present invention, the thruster includes the jet thruster 1 including the engine 10 corresponding to a drive source for the propulsion generator 11 that generates the propulsive force of the hull 101, and the boat control unit 8 is configured or programmed to perform a control to adjust the magnitude of the driving force of the engine 10 based on the predetermined state of the user U to change the propulsion speed of the hull 101. Accordingly, the magnitude of the driving force of the engine 10 is adjusted such that the propulsion speed of the hull 101 is easily changed.

According to a preferred embodiment of the present invention, the thruster includes the ballast tanks 20 (20*a*, 20*b*, and 20*c*) mounted on the hull 101 and the ballast pumps 21 to change the amounts of water stored in the ballast tanks 20, and the boat control unit 8 is configured or programmed to perform a control to adjust the amounts of water stored in the ballast tanks 20 with the ballast pumps 21 based on the predetermined state of the user U to change the shape of the wave toward the user U. Accordingly, the amounts of water stored in the ballast tanks 20 are adjusted by the ballast pumps 21 based on the predetermined state of the user U such that the shape of the wave toward the user U is easily changed.

According to a preferred embodiment of the present invention, the thruster includes the scoop devices 3 (3*a* and 3*b*) including the openable and closable water guide ports 30 and operable to generate a water flow toward the rear side of the hull 101 by opening the water guide ports 30, and the boat control unit 8 is configured or programmed to perform a control to switch the opening and closing of the water guide ports 30 of the scoop devices 3 based on the predetermined state of the user U to change the shape of the wave toward the user U. Accordingly, the opening and closing of the water guide ports 30 of the scoop devices 3 are switched such that the shape of the wave toward the user U is easily changed.

According to a preferred embodiment of the present invention, the image processor 6 is operable to determine the gesture G10, G11, G20, G21, G30, or G31 of the upper limb U1 of the user U imaged by the imager 5 as the predetermined marine vessel operating instruction of the user U, and the boat control unit 8 is configured or programmed to perform a control to adjust the thruster (the jet thruster 1, the ballast tanks 20, the ballast pumps 21, and the scoop devices 3) based on the gesture G10, G11, G20, G21, G30, or G31 of the upper limb U1 determined by the image processor 6 to change the propulsion state of the hull 101. Accordingly, the image processor 6 determines the gesture G10, G11, G20, G21, G30, or G31 of the upper limb U1 of the user U, which is a relatively easy-to-move body part, and the propulsion state of the hull 101 is changed. Thus, it becomes particularly easy for the user U towed by the hull 101 to change the propulsion state of the hull 101.

According to a preferred embodiment of the present invention, the boat control unit 8 is configured or programmed to perform a control to adjust the jet thruster 1 based on the image processor 6 determining that the upper limb U1 represents an upward pointing gesture G10 (see FIG. 6) to increase the propulsion speed of the hull 101, and adjust the jet thruster 1 based on the image processor 6 determining that the upper limb U1 represents a downward pointing gesture G11 (see FIG. 6) to decrease the propulsion speed of the hull 101. Accordingly, the propulsion speed of the hull 101 is changed by the simple gesture G10 or G11 in which the upper limb U1 is pointed upward or downward.

According to a preferred embodiment of the present invention, the boat control unit 8 is configured or programmed to perform a control to adjust the ballast tanks 20 and the ballast pumps 21 (the scoop devices 3) based on the image processor 6 determining that the predetermined finger of the hand of the upper limb U1 represents an upward pointing gesture G20 (see FIG. 8) to increase the size of the wave toward the user U, and adjust the ballast tanks 20 and the ballast pumps 21 (the scoop devices 3) based on the image processor 6 determining that the predetermined finger of the hand of the upper limb U1 represents a downward pointing gesture G21 (see FIG. 8) to decrease the size of the wave toward the user U. Accordingly, the size of the wave toward the user U is changed by the simple gesture G20 or G21 in which the predetermined finger of the hand of the upper limb U1 is pointed upward or downward.

According to a preferred embodiment of the present invention, the boat control unit 8 is configured or programmed to perform a control to adjust the scoop device 3*b* (the ballast tanks 20 and the ballast pumps 21) based on the image processor 6 determining that the upper limb U1 represents a leftward pointing gesture G30 (see FIG. 10) to generate the wave toward the user U on the port side of the hull 101, and adjust the scoop device 3*a* (the ballast tanks 20 and the ballast pumps 21) based on the image processor 6 determining that the upper limb U1 represents a rightward pointing gesture G31 (see FIG. 10) to generate the wave toward the user U on the starboard side of the hull 101. Accordingly, the wave toward the user U is generated on the port side or the starboard side of the hull 101 by the simple gesture G30 or G31 in which the upper limb U1 is pointed leftward or rightward.

According to a preferred embodiment of the present invention, the boat control unit 8 is configured or programmed to perform a control to adjust the jet thruster 1 to stop the hull 101 based on the image processor 6 determining that the predetermined state of the user U is the state in which the user U has fallen into the water. Accordingly, when the user U falls into the water, the hull 101 is automatically stopped without a marine vessel operator performing a stop operation.

According to a preferred embodiment of the present invention, the boat control unit 8 is configured or programmed to perform a control to adjust the jet thruster 1 to gradually increase the propulsion speed of the hull 101 based on the image processor 6 determining that the predetermined state of the user U is the state in which the lower limb of the user U is located in the water and the propulsion of the hull 101 is started when the hull 101 is stopped. Accordingly, when the propulsion of the hull 101 is started, the user U is automatically and smoothly shifted to a posture of riding on a wakesurfing board or a wakeboard without the marine vessel operator performing a start operation.

According to a preferred embodiment of the present invention, the image processor 6 is operable to individually determine the user U, and the boat control system 102 further includes the storage 7 to store the user determination data D2 of the user U determined by the image processor 6 and the adjustment control data D2*a* acquired by adjusting the thruster (the jet thruster 1, the ballast tanks 20, the ballast pumps 21, and the scoop devices 3) for each user U with the boat control unit 8 in association with each other. Furthermore, the boat control unit 8 is configured or programmed to perform a control to perform personal authentication of the user U based on the image data D1 of the user U captured by the imager 5 and the user determination data D2 stored in the storage 7 when the propulsion of the hull 101 is started, to identify the adjustment control data D2*a* associated with the user determination data D2 of the authenticated user U based on the result of the personal authentication, and to change the initial propulsion state of the hull 101 to the initial setting state for the authenticated user U based on the identified adjustment control data D2*a*. Accordingly, the towed user U is determined by personal authentication, and thus the initial propulsion state of the hull 101 is automatically set to an initial setting state such as a predetermined propulsion speed suitable for the towed user U.

According to a preferred embodiment of the present invention, the boat control unit 8 is configured or programmed to perform a control to automatically operate the jet propelled boat 100, and to perform a control to adjust the thruster (the jet thruster 1, the ballast tanks 20, the ballast pumps 21, and the scoop devices 3) based on the predetermined state of the user U determined by the image processor 6 to change the propulsion state of the hull 101 in addition to performing a control to automatically operate the jet propelled boat 100. Accordingly, the boat control unit 8 is used not only to automatically operate the jet propelled boat 100, but also for the towed user U to operate the jet propelled boat 100. Therefore, the system structure is simplified as compared with a case in which a dedicated control device for the towed user U to operate the jet propelled boat 100 is provided separately from the boat control unit.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the controller is preferably a boat control unit in preferred embodiments described above, the present invention is not restricted to this. In the present invention, the controller may alternatively be a control device having no function of performing a control to automatically operate the jet propelled boat such as a course hold control.

While the marine vessel is preferably a jet propelled boat including a jet thruster in preferred embodiments described above, the present invention is not restricted to this. In the present invention, the marine vessel may alternatively be an outboard motor boat including an outboard motor. Furthermore, in the present invention, the marine vessel may alternatively be an inboard motor boat including an inboard motor.

Figure 11:
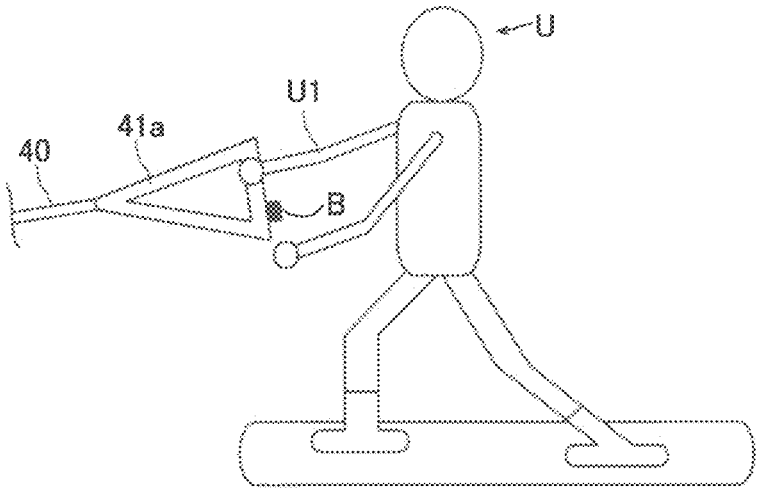
FIG. 11 is a diagram showing a handle including an on-off switch according to a modified example.

While the propulsion state of the hull is preferably changed based only on the predetermined state of the user in preferred embodiments described above, the present invention is not restricted to this. In the present invention, as shown in FIG. 11, an on-off switch B may alternatively be provided on a handle 41*a* connected to a hull via a rope 40 and gripped by a user U, and a controller may alternatively perform a control to adjust a thruster based on a combination of the predetermined state of the user determined by an image processor and the on or off state of the on-off switch to change the propulsion state of the hull. As an example, a control may be performed to increase the propulsion speed when the on-off switch B is pressed and a gesture in which the upper limb U1 of the user U is pointed upward is performed, and a control may be performed to increase the size of the wave when the on-off switch B is not pressed and a gesture in which the upper limb U1 of the user U is pointed upward is performed. Furthermore, a control may be performed to decrease the propulsion speed when the on-off switch B is pressed and a gesture in which the upper limb U1 of the user U is pointed downward is performed, and a control may be performed to decrease the size of the wave when the on-off switch B is not pressed and a gesture in which the upper limb U1 of the user U is pointed downward is performed. The on-off switch B is provided such that the image processor distinguishes between the predetermined state of the user U with the on-off switch B pressed and the predetermined state of the user U without the on-off switch B pressed, and thus the number of patterns of the predetermined state of the user U is increased.

While a control is preferably performed based on the gesture of the upper limb to change the propulsion state of the hull in preferred embodiments described above, the present invention is not restricted to this. In the present invention, a control may alternatively be performed based on a gesture of the lower limb, the head, or the whole body, for example, to change the propulsion state of the hull.

While the thruster preferably includes an engine as a drive source in preferred embodiments described above, the present invention is not restricted to this. In the present invention, the thruster may alternatively include a motor as a drive source. Furthermore, the thruster may alternatively include both an engine and a motor as drive sources.

While the controller and the image processor are preferably separate from each other in preferred embodiments described above, the present invention is not restricted to this. In the present invention, the controller and the image processor may alternatively be integral and unitary with each other.

The various predetermined states of the user that change the propulsion state of the thruster shown in preferred embodiments described above are merely examples, and in the present invention, the various predetermined states of the user that change the propulsion state of the thruster are not restricted to the ones shown in preferred embodiments described above.

While the hull preferably includes a scoop device in preferred embodiments described above, the present invention is not restricted to this. In the present invention, the hull may not include a scoop device.

While the hull preferably includes ballast tanks and ballast pumps in preferred embodiments described above, the present invention is not restricted to this. In the present invention, the hull may not include ballast tanks and ballast pumps.

While the process operations performed by the controller are described using flowcharts in a flow-driven manner in which processes are performed in order along a process flow for the convenience of illustration in preferred embodiments described above, the present invention is not restricted to this. In the present invention, the process operations performed by the controller may alternatively be performed in an event-driven manner in which the processes are performed on an event basis. In this case, the process operations performed by the controller may be performed in a complete event-driven manner or in a combination of an event-driven manner and a flow-driven manner.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat control system comprising:

an imager to image a user towed by a hull;

an image processor to determine a predetermined state of the user from an image captured by the imager; and a controller configured or programmed to perform a control to adjust at least one of a rotation speed or a direction of a thruster operable to change a propulsion state of the hull based on the predetermined state of the user determined by the image processor to change the propulsion state of the hull.

2. The boat control system according to claim 1, wherein the controller is configured or programmed to perform a control to adjust the thruster based on the predetermined state of the user determined by the image processor and indicating a predetermined marine vessel operating instruction to change the propulsion state of the hull.

3. The boat control system according to claim 2, wherein the controller is configured or programmed to perform a control to adjust the thruster based on a gesture of the user determined by the image processor and indicating the predetermined marine vessel operating instruction to change the propulsion state of the hull.

4. The boat control system according to claim 1, wherein the image processor is operable to determine that the user is in the predetermined state when the predetermined state of the user is continuously imaged by the imager for a predetermined period of time or longer.

5. The boat control system according to claim 1, wherein the controller is configured or programmed to perform a control to adjust the thruster to change at least one of a propulsion speed of the hull or a shape of a wave toward the user.

6. The boat control system according to claim 5, wherein the thruster includes at least one of an engine or a motor corresponding to a drive source for a propulsion generator operable to generate a propulsive force of the hull; and the controller is configured or programmed to perform a control to adjust the rotation speed of at least one of the engine or the motor based on the predetermined state of the user to change the propulsion speed of the hull.

7. The boat control system according to claim 5, wherein the thruster includes a ballast tank mounted on the hull and a ballast pump to change an amount of water stored in the ballast tank; and the controller is configured or programmed to perform a control to adjust the amount of water stored in the ballast tank with the ballast pump based on the predetermined state of the user to change the shape of the wave toward the user.

8. The boat control system according to claim 5, wherein the thruster includes a scoop including an openable and closable water guide port and operable to generate a water flow toward a rear side of the hull by opening the openable and closable water guide port; and the controller is configured or programmed to perform a control to switch opening and closing of the water guide port of the scoop based on the predetermined state of the user to change the shape of the wave toward the user.

9. A boat control system comprising:

an imager to image a user towed by a hull;

an image processor to determine a predetermined state of the user from an image captured by the imager; and a controller configured or programmed to perform a control to adjust a thruster operable to change a propulsion state of the hull based on the predetermined state of the user determined by the image processor to change the propulsion state of the hull; wherein the controller is configured or programmed to perform a control to adjust the thruster based on the predetermined state of the user determined by the image processor and indicating a predetermined marine vessel operating instruction to change the propulsion state of the hull;

the controller is configured or programmed to perform a control to adjust the thruster based on a gesture of the user determined by the image processor and indicating the predetermined marine vessel operating instruction to change the propulsion state of the hull;

the image processor is operable to determine at least one of the gesture of an upper limb of the user or the gesture of a lower limb of the user imaged by the imager as the predetermined marine vessel operating instruction of the user; and the controller is configured or programmed to perform a control to adjust the thruster based on at least one of the gesture of the upper limb or the gesture of the lower limb determined by the image processor to change the propulsion state of the hull.

10. The boat control system according to claim 9, wherein the controller is configured or programmed to perform a control to:

adjust the thruster based on the image processor determining that the upper limb or a predetermined finger of a hand of the upper limb represents an upward pointing gesture to increase a propulsion speed of the hull; and adjust the thruster based on the image processor determining that the upper limb or the predetermined finger of the hand of the upper limb represents a downward pointing gesture to decrease the propulsion speed of the hull.

11. The boat control system according to claim 9, wherein the controller is configured or programmed to perform a control to:

adjust the thruster based on the image processor determining that the upper limb or a predetermined finger of a hand of the upper limb represents an upward pointing gesture to increase a size of a wave toward the user; and adjust the thruster based on the image processor determining that the upper limb or the predetermined finger of the hand of the upper limb represents a downward pointing gesture to decrease the size of the wave toward the user.

12. The boat control system according to claim 9, wherein the controller is configured or programmed to perform a control to:

adjust the thruster based on the image processor determining that the upper limb represents a leftward pointing gesture to generate a wave toward the user on a port side of the hull; and adjust the thruster based on the image processor determining that the upper limb represents a rightward pointing gesture to generate the wave toward the user on a starboard side of the hull.

13. The boat control system according to claim 1, wherein the controller is configured or programmed to perform a control to adjust the thruster to stop the hull based on the image processor determining that the predetermined state of the user is a state in which the user has fallen into water.

14. The boat control system according to claim 1, wherein the controller is configured or programmed to perform a control to adjust the thruster to gradually increase a propulsion speed of the hull based on the image processor determining that the predetermined state of the user is a state in which a lower limb of the user is located in water and propulsion of the hull is started when the hull is stopped.

15. The boat control system according to claim 1, wherein the image processor is operable to individually determine the user;

the boat control system further comprises a storage to store user determination data of the user determined by the image processor and adjustment control data acquired by adjusting the thruster for each user with the controller in association with each other; and the controller is configured or programmed to perform a control to:

perform personal authentication of the user based on image data of the user captured by the imager and the user determination data stored in the storage when propulsion of the hull is started;

identify the adjustment control data associated with the user determination data of the authenticated user based on a result of the personal authentication; and change an initial propulsion state of the hull to an initial setting state for the authenticated user based on the identified adjustment control data.

16. The boat control system according to claim 1, wherein the controller includes a boat control unit configured or programmed to perform a control to automatically operate a marine vessel; and the boat control unit is configured or programmed to perform a control to adjust the thruster based on the predetermined state of the user determined by the image processor to change the propulsion state of the hull in addition to performing the control to automatically operate the marine vessel.

17. The boat control system according to claim 1, further comprising a handle including an on-off switch, connected to the hull via a rope, and gripped by the user; wherein the controller is configured or programmed to perform a control to adjust the thruster based on a combination of the predetermined state of the user determined by the image processor and an on or off state of the on-off switch to change the propulsion state of the hull.

18. A marine vessel comprising:

a hull; and a boat control system mounted on the hull; wherein the hull includes a thruster to change a propulsion state of the hull; and the boat control system includes:

an imager to image a user towed by the hull;

an image processor to determine a predetermined state of the user from an image captured by the imager; and a controller configured or programmed to perform a control to adjust at least one of a rotation speed or a direction of the thruster based on the predetermined state of the user determined by the image processor to change the propulsion state of the hull.

19. The marine vessel according to claim 18, wherein the controller is configured or programmed to perform a control to adjust the thruster based on the predetermined state of the user determined by the image processor and indicating a predetermined marine vessel operating instruction to change the propulsion state of the hull.

20. The marine vessel according to claim 18, wherein the thruster includes a jet thruster to jet water; and the marine vessel is a jet propelled boat.

* * * * *